US012123132B1

(12) United States Patent
North et al.

(10) Patent No.: US 12,123,132 B1
(45) Date of Patent: Oct. 22, 2024

(54) TREATMENT SHEETS AND METHODS FOR USING TREATMENT SHEETS

(71) Applicant: ALADDIN MANUFACTURING CORPORATION, Calhoun, GA (US)

(72) Inventors: Melissa North, Calhoun, GA (US); Mack Brindle, Calhoun, GA (US); Christina Maria Hooker, Calhoun, GA (US); Dennes Ozuna, Calhoun, GA (US)

(73) Assignee: ALADDIN MANUFACTURING CORPORATION, Calhoun, GA (US)

( * ) Notice: Subject to any disclaimer, the term of this patent is extended or adjusted under 35 U.S.C. 154(b) by 0 days.

(21) Appl. No.: 18/304,476

(22) Filed: Apr. 21, 2023

(51) Int. Cl.

| | |
|---|---|
| ***D06M 15/507*** | (2006.01) |
| ***D06B 1/02*** | (2006.01) |
| ***D06M 13/00*** | (2006.01) |
| ***D06M 13/53*** | (2006.01) |
| ***D06M 23/02*** | (2006.01) |
| ***D06P 5/04*** | (2006.01) |
| *D06M 101/32* | (2006.01) |

(52) U.S. Cl.
CPC ..... *D06M 15/507* (2013.01); *D06B 1/02* (2013.01); *D06M 13/00* (2013.01); *D06M 13/53* (2013.01); *D06M 23/02* (2013.01); *D06P 5/04* (2013.01); *D06M 2101/32* (2013.01); *D06M 2200/01* (2013.01); *D06M 2200/25* (2013.01); *D06M 2200/30* (2013.01); *D06M 2200/50* (2013.01)

(58) Field of Classification Search
CPC ..... D06P 1/0036; D06P 1/22; D06P 5/2077; D04H 1/4334; D04H 1/435; D04H 3/009; D04H 3/011; D04H 3/523; D06B 3/10; D06M 16/00; D06M 23/02; D06M 2101/32; D06M 2200/30; D10B 2331/02; D10B 2503/04
See application file for complete search history.

(56) References Cited

U.S. PATENT DOCUMENTS

| | | | | |
|---|---|---|---|---|
| 2003/0207785 | A1* | 11/2003 | Mattia | C11D 3/001 510/515 |
| 2010/0251486 | A1 | 10/2010 | Yu et al. | |
| 2011/0094906 | A1* | 4/2011 | Thomas | D06M 13/005 206/459.5 |
| 2013/0081299 | A1* | 4/2013 | Vasquez | D06F 58/203 34/389 |
| 2016/0101204 | A1 | 4/2016 | Lynch | |
| 2016/0258105 | A1* | 9/2016 | Hernandez | D06F 58/203 |
| 2017/0283750 | A1* | 10/2017 | Denny | C11D 17/047 |
| 2020/0165544 | A1* | 5/2020 | Stern | C11D 17/047 |

FOREIGN PATENT DOCUMENTS

| | | | | |
|---|---|---|---|---|
| CN | 103866583 | * | 6/2014 | |
| WO | WO 98/12296 | * | 3/1998 | C11D 3/37 |

OTHER PUBLICATIONS

Restriction Requirement issued in U.S. Appl. No. 18/304,487, mailed Oct. 18, 2023.
1 Non-Final Office Action issued in co-pending U.S. Appl. No. 18/304,487, mailed Dec. 15, 2023.
Notice of Allowance issued in U.S. Appl. No. 18/304,487, mailed Mar. 29, 2024.

* cited by examiner

*Primary Examiner* — Amina S Khan
(74) *Attorney, Agent, or Firm* — Meunier Carlin & Curfman LLC

(57) ABSTRACT

Soft surface articles may be treated during manufacture with treatment sheets loaded with treatment chemicals while drying the articles. This eliminates a step of adding the treatment chemicals to a water bath containing the treatment chemicals. Eliminating this step reduces the amount of water used in the manufacture of the soft surface articles and also removes the requirement of having to process a vat of waste water.

10 Claims, 1 Drawing Sheet

TREATMENT SHEETS AND METHODS FOR USING TREATMENT SHEETS

FIELD OF THE INVENTION

The present invention relates to treatment sheets and treatment chemicals for use in the preparation of rugs mats, other soft surfaces, and other textile products, and methods for using the treatment sheets and treatment chemicals.

BACKGROUND OF THE INVENTION

Commonly, many people prefer rugs and mats that have a softer feel. In many cases producing this softness is done by adding conditioners in the manufacturing process of making the articles. The common practice has been to add a softener and other treatment chemicals to a batch of unfinished rugs or mats in the latter stages of the wet phase of processing. The wet phase of processing comprises the steps of dyeing and preparing the rugs and mats before drying them. Most commonly, a softener has been added after the rugs and mats have already been dyed and rinsed. The dry phase of processing comprises drying and further preparing the finished soft surfaces for shipping and delivery.

This sequence of adding the softener and any other treatment chemicals after the dyeing process has been known to prevent the softener, and any other treatment chemicals that are being added, from interfering with the dyeing process. In other words, it has been found that adding treatment chemicals such as a fabric softener with, or before, the dying step has led to the fibers in the rug or mat being inconsistently dyed or dyed to a color that was not the intended color. Rather than risking insufficient or inappropriate dyeing, the common practice has been to add the softener and other treatment chemicals after a batch of articles has been dyed and initially rinsed.

The restriction against combining the dye with the treatment chemicals has led to a traditional process of applying treatment chemicals to articles. In this traditional process, a quantity of rugs or mats are treated in a dye solution until the dye has permeated the fabric and sets. In some cases, this may include boiling the articles in a dye solution. The water containing excess dye is drained as wastewater where it must be treated. The articles may then be rinsed, thus creating more wastewater.

After that, the articles are processed in another solution, such as a water bath, where fabric softeners and other treatment chemicals are added. That water, along with the remaining treatment chemicals, is then drained and additionally becomes wastewater. The treated soft surface articles are then dried and finally prepared for distribution. In this traditional method, up to 75% of the treatment chemicals are drained away while only 25% of the treatment chemicals are retained on the articles.

SUMMARY OF THE INVENTION

The present inventions disclosed and taught herein are directed to treating unfinished soft surfaces and other textile products in the manufacturing process to reduce the amount of water used and the time taken for processing by applying treatment chemicals in the wet phase of the process without having to add any treatment chemicals in a second water bath.

The present inventions are also directed towards reducing the amounts of water that must be treated from the transfer of treatment chemicals to textile products and improving the transfer and retention of treatment chemicals in soft surfaces and other fabrics.

In another embodiment, the inventions relate to methods of applying treatment chemicals to textile products, and all other types of fabric using one or more treatment sheets containing treatment chemicals. While a preferred embodiment is to apply this during the manufacturing steps of the textile products, another embodiment is to apply a treatment sheet to textile products by a consumer or commercial processor to refurbish a textile product. This may be preferred by a consumer or commercial processor, such as a laundry or cleaner, to regenerate the pile of rugs or mats while adding treatment chemicals such as softeners, fire retardants, soiling deterrents, and other treatment chemicals known to those ordinarily skilled in the art.

In another embodiment, the inventions relate to processes for creating treatment sheets for the use of treating rugs and/or mats.

In another embodiment, the inventions relate to the transfer of treatment chemicals to soft surfaces without transferring the treatment chemicals to the backings of the soft surfaces. In other embodiments, some portions of treatment chemicals may be transferred to the backing or backings of articles.

In another embodiment, the inventions relate to methods of preparing treatment sheets for use.

In another embodiment, the inventions relate to methods of determining amounts of treatment chemicals, and adding those amounts of treatment chemicals to batches of textile product articles.

Descriptions of these inventions will be defined in the appended independent claims, while preferred embodiments are defined in the dependent claims.

In a first independent aspect the invention relates to a method of applying at least one treatment chemical to finish a plurality of unfinished dyed and rinsed textile products, comprising: placing the plurality of unfinished dyed and rinsed textile products into a dryer; and adding at least one treatment sheet bundle loaded with the at least one treatment chemical to the dryer.

In a second independent aspect, the invention relates to a method of making a treatment sheet, comprising: providing a sheet; loading the sheet with at least one treatment chemical via aqueous treatment; and drying the sheet.

In a third independent aspect, the invention relates to a method for manufacturing a textile product, comprising: dyeing the textile product in a dye solution in a vat; draining the residual dye solution from the vat; rinsing the textile product; transferring the wet textile product to a dryer; adding at least one treatment sheet comprising at least one chemical to be transferred to the textile product.

In a fourth independent aspect, the invention relates to a method for treating a textile product, comprising: placing the textile product into a dryer along with at least one treatment sheet; wherein the treatment sheet comprises at least one treatment chemical; and heating the textile product in contact with the at least one treatment sheet.

In a fifth independent aspect, the invention relates to a method of manufacturing a batch of soft surface articles, comprising: providing a batch of wet soft surface articles wherein at least one soft surface article in the batch of soft surface articles comprises a backing; placing the batch of soft surface articles into a dryer along with at least one treatment sheet bundle; wherein the treatment sheet bundle comprises at least one treatment chemical; and drying the batch of soft surface articles in contact with the at least one treatment sheet bundle.

In a sixth independent aspect, the invention relates to a method of transferring a treatment chemical to a fabric with a backing, comprising: providing a dryer; placing the fabric with a backing into the dryer; placing at least one treatment sheet bundle into the dryer wherein the treatment sheet bundle comprises at least one treatment chemical; and activating the dryer to contact the treatment sheet bundle with the fabric with a backing.

In a seventh independent aspect, the invention relates to a method of conserving water in the application of a treatment chemical to a soft surface article comprising: providing a dyeing vat and a dryer; dyeing the soft surface article in the dyeing vat with a water-based dye; draining the water-based dye from the vat without refilling the vat; moving the soft surface article to the dryer; adding a treatment sheet bundle to the dryer; and drying the soft surface article in the dryer with the treatment sheet bundle.

In an eighth independent aspect, the invention relates to a method for manufacturing a batch of soft surface articles, comprising: providing a batch of unfinished soft surface articles comprising a fabric face and a backing; dyeing the batch of soft surface articles in a water-based dye solution in a vat; draining the water-based dye solution from the vat without refilling the vat; transferring at least a portion of the batch of soft surface articles to a dryer; adding at least one treatment sheet bundle to the dryer, wherein the at least one treatment sheet bundle comprises at least one treatment chemical; and drying the at least a portion of the batch of soft surface articles with the at least one treatment sheet bundle.

In a ninth independent aspect, the invention relates to a method of loading a treatment sheet with at least one treatment chemical, comprising: providing a section of treatment sheet material, wherein the section of treatment sheet material has a width; providing a plurality of sprayers configured to spray the at least one treatment chemical at a configured rate on at least a portion of the treatment sheet material; and passing the portion of the section of the treatment sheet material through an oven.

In a tenth independent aspect, the invention relates to a method for treating a batch of soft surface articles, comprising: providing a batch of unfinished soft surface articles comprising a fabric face; wetting the batch of soft surface articles in a vat; draining the water from the vat without refilling the vat; transferring at least a portion of the batch of soft surface articles to a dryer; adding at least one treatment sheet bundle to the dryer, wherein the at least one treatment sheet bundle comprises at least one treatment chemical; and drying the at least a portion of the batch of soft surface articles with the at least one treatment sheet bundle.

BRIEF DESCRIPTION OF THE DRAWINGS

With the intention of better showing the characteristics of the invention, herein after, as an example without any limitative character, some preferred embodiments are described, with reference to the accompanying drawings, wherein.

DETAILED DESCRIPTION

Figure 1:
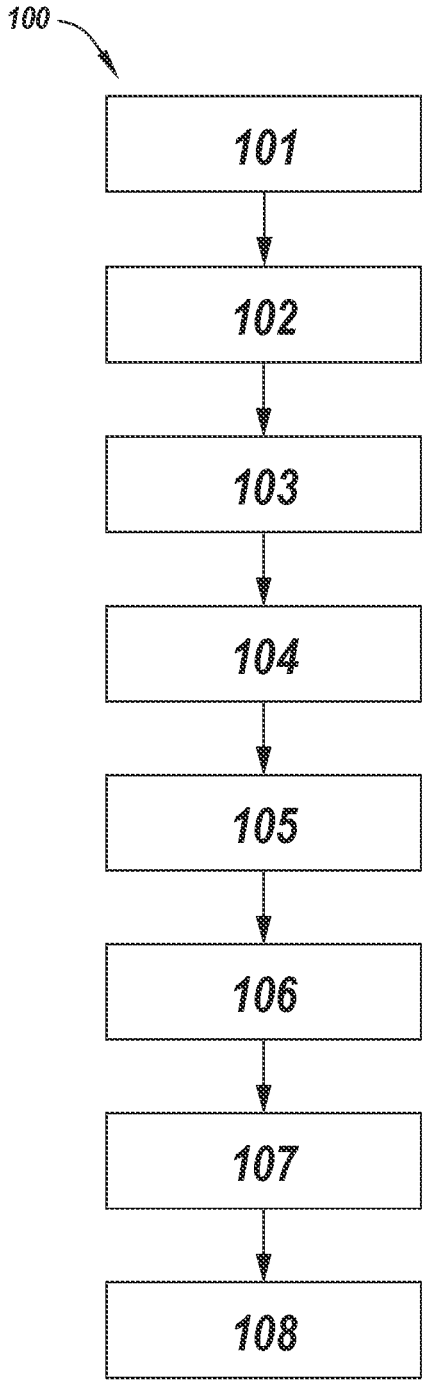
FIG. 1 represents a prior art method for treating soft surfaces.

FIG. 1 represents a prior art method 100 for treating soft surfaces and other textile products.

Rugs, mats, other soft surfaces, and other textile products may be created by processes known to those ordinarily skilled in the art. Once created, some of the articles may be dyed to a desired color. Step 101 comprises placing a batch of unfinished articles into a dyeing vat and adding a solution of dye until the dye has contacted and infused the article. In some cases, this step may comprise boiling the articles in the vat with a water-based dye. In some cases, the amount of time required to set the dye by boiling in the vat is about an hour. Some dyes and processes use more time and some dyes and processes use less time. In some cases, the vat may be agitated to distribute the dye to all of the articles.

Similarly, while some of the exemplary embodiments reference water and water-soluble treatment chemicals, the inventions disclosed herein are not so limited. Other solvents may be used with treatment chemicals that may be fully or partially soluble in them.

In the case where the articles are bathmats, a batch may be between 300 and 350 bathmats. Rather than referencing a batch as a number of articles, it may be more convenient to refer to a face-weight and/or a total-weight of a batch. A total-weight, in this situation, is the total dry weight of a batch of articles that are being processed. This includes the face and the backing (or backings). In some cases, only the face of the article will retain any treatment chemicals. In those cases, the backing may be impervious to the dye and all of the treatment chemicals that are to be retained by the faces of the articles. The collective face-weight of a batch may also be called or known as the weight of fiber (WoF).

In Step 102, the dye solution may be drained from the vat. In some cases, the batch of articles may be rinsed to remove more of the dye solution that may be adhering to the articles. This may be more useful in bathmats with a deep pile than in thin mats or dish towels.

In some cases where the articles are boiled in a water-based dye, the articles may still be hot. A cold water rinse may be used to reduce the temperature of the articles along with removing more of the excess dye solution. Alternatively, or in combination, the vat may be spun to centrifugally sling off more residual dye solution.

In Step 103, the vat with the articles may be refilled with water. In one case, this step may be combined with Step 104 where the treatment chemicals are added to the vat. That is to say that the water used to refill the vat may already have treatment chemicals in it. In many cases, treatment chemicals in the water bath may be left to contact the articles for a time needed for the treatment chemicals to permeate and act upon the articles.

In Step 104, if it was not already done in Step 103, the treatment chemicals are dispersed throughout the water in the vat where they will contact the articles. In some cases, this may be approximately one hour. In some cases, the vat may be agitated and/or stirred during Step 104 to aid in the distribution of the treatment chemicals so they may fully permeate and interact with the articles. In those cases, an operator treating a batch of articles with a dye and/or treatment chemicals will only need a face-weight of the batch to determine amounts of dye and/or amounts of treatment chemicals that will need to be added to the batch. As has been noted, however, for the articles to absorb and retain target amounts of treatment chemicals, up to 4 times as much treatment chemicals as is absorbed must be added to the water in the vat.

As noted, the amounts of treatment chemicals may be calculated from the face-weight of the batch if the efficacy of absorption of each of the treatment chemicals is known. In many wet phase cases, an abundance of chemicals are added to the vat to ensure that all of the articles have been contacted with the treatment chemicals so that the chemicals are distributed among and absorbed into the faces and/or backings of the articles. That is to say that if a batch of articles can absorb and retain a certain amount of a treatment chemical, a larger amount was usually added in the wet phase to ensure that all of the articles have absorbed and will retain a target amount of the treatment chemical. In some cases, amounts of up to four times the amount of absorbed treatment chemical have been added to the dye vat with the expectation that the articles will absorb and retain the target amount of that treatment chemical by each of the articles in the batch. This means that the remaining unabsorbed and unretained treatment chemical will be unused in this step and flushed out of the vat to be processed as wastewater.

Step 105 illustrates that the vat may again be drained. As in Step 102, in some cases, the articles may be rinsed to more fully remove any excess dye solution and any excess treatment chemicals. As noted, the vat may be spun to sling off some excess dye solution.

Step 106 illustrates that the articles may be moved to a dryer. In some cases, the dyeing vat may be mechanized to tip and spill out the articles. In some cases, the dyeing vat may be immovable and the articles must be lifted out from an opening.

Step 107 illustrates that the articles may be dried. In many cases, this may be at an elevated temperature. In some cases, the dryer may spin the articles to centrifugally move the water from the articles, or otherwise agitate the articles to separate the articles so they may dry more evenly and quickly.

In some cases, the step of drying at an elevated temperature sets the dye and the treatment chemicals in the articles. In other cases, the dye and treatment chemicals may already be set in the articles before the step of drying.

Step 108 illustrates that the finished articles must be unloaded from the dryer. Similar to some dyeing vats, some dryers are configured to tilt and spill out their contents while others may be immovable, and the articles must be lifted or otherwise transported out of the dryer.

After the removal of the finished articles from the dryer, the articles may be further processed by inspecting them, packaging them, and shipping them to consumers or distributors.

Figure 2:
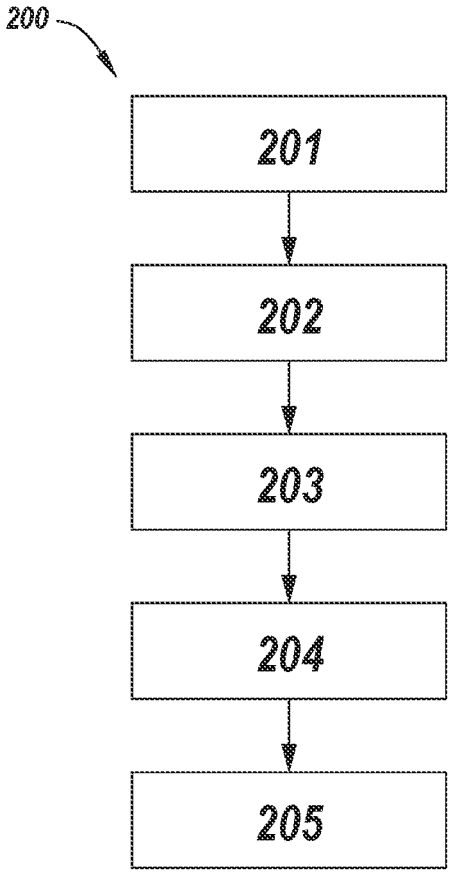
FIG. 2 represents a method of treating soft surfaces according to the inventions taught and disclosed herein.

Turning now to the improved methods of using treatment sheets, FIG. 2 illustrates an exemplary embodiment of using treatment sheets to treat batches of articles. The method 200 starts like the traditional method 100, where Step 201 comprises placing a batch of unfinished articles into a dyeing vat and adding a solution of dye until the dye has contacted and infused the article. In some cases, this step may comprise boiling the articles in the vat with a water-based dye for about an hour.

In Step 202, the dye solution may be drained from the vat. In some cases, the batch of articles may be rinsed to remove more of the excess dye solution that may be adhering to the articles. A spin rinse in this step may be more effective for soft surface articles such as bathmats that have a deep pile than in single-layer articles such as dish towels.

Step 203 illustrates that the articles may be moved to a dryer. In some cases, the dyeing vat may be mechanized to tip and spill out the articles. In some cases, the dyeing vat may be immovable, and the articles must be transported out of the vat.

Step 204 illustrates that at least one or more treatment sheets may be added to the dryer.

Step 205 illustrates that the articles may be dried. In some cases, this may be at an elevated temperature. In some cases, the dryer may spin the articles to centrifugally move the water from the articles, or otherwise agitate the articles to separate the articles so they may dry more evenly and quickly. In some cases, the drying cycle may be around 45 minutes. In other cases, the drying cycle may be around an hour. In some cases, the temperature of the dryer will be between about 300° F. to about 350° F. (about 148.9° C. to about 167.7° C.). In a preferred embodiment, the temperature of the dryer will be between 310° F. and 320° F. (154.4° C. and 160° C.) with a more preferred embodiment of a temperature of 315° F. (157.2° C.).

Any action or motion within the dryer will cause the treatment sheet or sheets to interact with the articles. Spinning and/or tumbling of the articles with the treatment sheet or sheets in the dryer will facilitate the transfer of the treatment chemicals to the textile products.

Composition of Treatment Sheets

Treatment sheets may be made from any number of fabrics, such as but not limited to a sheet of a woven or non-woven material. The material may be made of natural fibers such as cellulosic plant-based material or such as synthetic fibers, or blends of such natural and synthetic fibers. Other materials that are sufficiently absorbent may be used as well. The fibers in a treatment sheet may be entangled by means known to those ordinarily skilled in the art. In a preferred embodiment, the treatment sheet material may be a non-woven spunbonded polyester. In other embodiments, the material may be a woven or non-woven spunlace or meltblown.

As may be seen in these listed embodiments, the durability of the treatment sheet fabric must be suitable for the purpose. In an embodiment where the treatments sheets are single-use, the fabric must still be hardy enough to withstand the rigors of a single timed drying cycle without breaking down or leaving lint or other particulates on the articles. Similarly, multi-use treatment sheets must be strong enough to be used for a number of times and still retain the treatment chemicals. Also, reusable treatment sheets must be of sufficient quality to be reusable and reloadable many times. Other embodiments may be envisioned by those in possession of this disclosure and aware of the inventions disclosed herein without departing from the spirit of the inventions.

In envisioned embodiments, solids in the form of granules and/or powders may be embedded within the fabric of the treatment sheet material. In exemplary embodiments, it may be desirable to have granules or powders of odor controlling substances retained within the treatment sheet material. Examples of odor controlling materials are, without limitation, activated charcoal and baking powder. These substances may be granules that are embedded within the fabric of the treatment sheet material. In other embodiments, these may be coarse or fine powders within enclosures such as sachets that are retained within the fabric of the treatment sheets such that the powders will not be released from the treatment sheets.

In other envisioned embodiments, the treatment sheets may be laminated with layers of materials that have different properties. In this, one layer may be hydrophilic so that water-suspended treatment chemicals may be absorbed into the treatment sheet, while another layer may be hydrophobic to allow the absorption of treatment chemicals that are solvent-suspended, where the solvent may be organic and/or nonpolar.

Applicant has found that non-woven polyester sheets having a nominal thickness of between 0.5 and 5 millimeters provide satisfactory results. In a preferred embodiment, the thickness may be between 1 and 3 millimeters.

As noted herein, the treatment sheets may be of any length and width. Having sheets with a length and width of about 12" by about 12" (about 30.5 cm by about 30.5 cm) has provided satisfactory results as has sheets with about 9" by about 9" (about 22.9 cm by about 22.9 cm). In a preferred embodiment, treatment sheets of about 12" by about 9" (about 30.5 cm by about 22.9 cm) have provided satisfactory results.

In other embodiments, widths may range between about 20" (about 50 cm) and about 5" (about 12 cm) with lengths of about the same range where the forms may be square or rectangular.

Forms of Treatment Sheets

In some embodiments of the improved method 200, a plurality of treatment sheets may be added. In many of those embodiments each treatment sheet may be in a square or rectangular shape. Applicant has tested treatment sheets of approximately 12 inches by approximately 9 inches (about 12" by about 9"—about 30.5 cm by about 22.9 cm) with satisfactory results. Other sizes may be used without departing from the spirit of the inventions taught and disclosed herein. Treatment sheets in this configuration may be added individually or in bundles of sheets. In a preferred embodiment, Applicant has satisfactory results with a bundle of treatment sheets that are secured together before being added to a dryer.

One method of securing treatment sheets together may be to punch a hole in a bundle of treatment sheets and place a securing member through the hole with retaining structures on each end. One of many examples of this would be a threadable member with washers and bolts on each end. In one embodiment, the threadable member may be a nut such that only a single bolt need be placed on the other end and tightened to secure the bundle.

Another method of securing a bundle of treatment sheets together may be by stitching them together.

Another method of securing a bundle of treatment sheets together may be with a deformable member. One of many examples of deformable members may be a staple that pierces the bundle of treatment sheets such that the crown is on one side of the bundle and the legs are folded together or spayed apart on the other side.

While Applicant has achieved desirable success with a single staple through a bundle of treatment sheets, another method of securing a bundle of treatment sheets together may be with a tagging gun that inserts one or more tagging gun fasteners through the bundle of sheets. A tagging gun would be capable of inserting a fastener through the bundle of treatment sheets without disturbing the fabric of the treatment sheets, in a similar way that a staple would not disturb the fabric. Also, having a tagging gun fastener of sufficient length would allow the treatment sheets some freedom of movement axially along the length of the fastener and rotationally to the axis. These freedoms of movements and an elimination of a compression of the treatment sheets together, such as a staple may produce, may expose more of the surfaces of the treatment sheets to the articles to be treated while still securing the treatment sheets together.

Applicant prefers that the material used for securing the bundle together not have any effect on the articles or the dryer and will not degrade. That is to say that a metal fastener may corrode and leave rust stains on the articles, or it may scratch the interior of the dryer. Alternatively, a soft plastic fastener may deform or fail under the heat and/or motions of a drying cycle. Those of skill in the art will be able to envision and produce apparatuses for securing articles together that have the described preferred features without departing from the spirit of the inventions taught and disclosed herein.

In one embodiment, 25 or more treatment sheets may be secured together. In another embodiment, between 25 and 50 treatment sheets may be secured together. In another embodiment between 25 and 75 treatment sheets may be secured together. In another embodiment, between 50 and 75 treatment sheets may be secured together. In another embodiment, between 50 and 100 treatment sheets may be secured together. In another embodiment, between 75 and 100 treatment sheets may be secured together. In another embodiment, between 75 and 125 treatment sheets may be secured together. In another embodiment, between 100 and 125 treatment sheets may be secured together. In another embodiment, between 100 and 150 treatment sheets may be secured together. In another embodiment, between 125 and 150 treatment sheets may be secured together. In another embodiment, less than 150 treatment sheets may be secured together. In a preferred embodiment, approximately 100 treatment sheets may be secured together.

In an envisioned embodiment, treatment sheets cut into rectangles or squares may be replaced by a rolled length of treatment sheet. In this embodiment, a single roll of a treatment sheet may be added to a dryer containing a batch of articles rather than a bundle of treatment sheets secured together. That is to say that a bundle of 100 treatment sheets of 12 inches by 9 inches (about 12" by about 9"—about 30.5 cm by about 22.9 cm) may be replaced by a roll of treatment sheet material having an axial length of 9 inches (22.9 cm) and an unrolled length of 120 feet (36.6 meters). A roll of treatment sheet material is another form of a bundle of treatment sheets. That is to say that a bundle of individual treatment sheets that are bound together will have the same amounts of treatment chemicals as a length of a roll of treatment sheet material if both are prepared in the same way. The term treatment sheet bundle encompasses both a roll of treatment sheet material and a set of individual treatment sheets.

While a preferred embodiment has all of the desired treatment chemicals in their desired proportions on a single bundle of treatment sheets, or in a single roll of treatment sheets, other embodiments have been envisioned that may have other preferred qualities. In one exemplary embodiment, one set of treatment sheets may be loaded with one group of treatment chemicals, while another set of treatment sheets may be loaded with another group of treatment chemicals. In this embodiment, enough bundles of each of the treatment sheets may be added to a batch of articles to treat all of the articles with a target amount of both groups of treatment chemicals. This embodiment may be applied to rolls of treatment sheets as well.

While a preferred embodiment may contain all of the treatment chemicals evenly distributed along the length of the roll, other embodiments may have the roll comprised of sections where each section has been loaded with an appropriate amount of one or more treatment chemicals such that the entire length of the roll contains all of the treatment chemicals desired to be transferred to the batch of articles.

Along those lines, each of the treatment sheets in a bundle of treatment sheets do not have to contain identical amounts of the treatment chemicals. It may be preferable to have some of the treatment sheets in a bundle contain a first group of treatment chemicals while other treatment sheets in the bundle contain a second group of treatment chemicals.

It must be noted that the term treatment sheet used herein may be used to describe a square or rectangular treatment sheet, as well as a roll of treatment sheet. Other than some distinction between their sizes, they may be interchangeably used in all of the embodiments taught and disclosed herein.

Treatment Chemicals

A plethora of different treatment chemicals may be applied to and retained in the treatment sheets. This includes, but it not limited to: softeners; waxes; soil-release agents; antimicrobial agents; fire retardants; odor eliminators; perfumes or other fragrances; anti-static agents; color fastness agents; lightfastness agents; UV absorbers; optical brighteners; leveling agents; and essential oils. That is to say that any additive that can enhance the appearance, feel, or other physical properties of the treated article may be used with the treatment sheets disclosed and taught herein. That is to say that any treatment chemical that has been added in the prior art method 100 to treat fabric articles may be added to a treatment sheet and used in Applicant's improved method 200.

In some embodiments, the softener may comprise an emulsion of soap and olive oil, corn oil, or tallow oil, or combinations. It may also comprise any silicone-based compound, such as polydimethylsiloxane, or it may comprise any cationic fabric softener.

In some embodiments, the wax may be any paraffin or natural beeswax.

In some embodiments, the soil release agent may comprise methyl cellulose, ethyl cellulose, hydroxypropyl starch, hydroxyethyl cellulose, hydroxypropylmethyl cellulose and hydrolyzed cellulose acetates, or combinations.

In some embodiments, the antimicrobial agent may comprise silver, zinc, copper, any silane quaternary salt, or any essential oil that has antimicrobial properties.

In some embodiments, the fire retardant agent may be any non-halogenated phosphorous based additive.

In some embodiments, the odor eliminators may comprise Borax, or sodium tetraborate.

In some embodiments, the anti-static agents may comprise any non-ionic compounds, such as polyethylene glycols, ethoxylated fatty alcohols and sorbitan fatty acid esters, or combinations.

In many embodiments, the treatment chemicals that are added in the traditional method 100 Step 103 or 104 were added as concentrated liquids. In those cases, a face-weight of articles was obtained and amounts of treatment chemicals to be added were calculated from the face-weight. As noted, this must take into account the efficacy of retention, which can be very low in the prior art method 100. Those amounts of the treatment chemicals were measured out and added to the water in the vat as noted in the prior art method 100.

Loading

Those of ordinary skill in the art and in possession of the inventions disclosed herein will understand that it is desirable to deliver specific amounts of treatment chemicals to the articles in a batch of articles to be treated. That is to say that in an exemplary embodiment, an operator charged with treating a number of mats with a fire retardant, such as but not limited to a non-halogenated, phosphorus based additive, could determine a number of treatment sheets to be added to the batch of mats by knowing how much fire retardant is contained in each treatment sheet and how much of the fire retardant is needed to treat each mat in the batch. For example, if each sheet contains 10 grams of fire retardant; each mat is to be treated with 2 grams of fire retardant; and there are 1,000 mats to be treated in the batch; then an operator would calculate that 200 treatment sheets would be needed to deliver a target of 2 grams of fire retardant to each mat in the batch if the efficacy of transfer and retention were 100%. Appropriate adjustments may be made to account for the efficacy of transfer and retention as is discussed herein. Those ordinarily skilled in the art will understand that the method of calculating a number of treatment sheets to be used may be applied to a face-weight or to a total-weight of a batch of articles.

Any number of chemicals may be applied to the treatment sheets in ways that are known to those ordinarily skilled in the art. These chemicals do not have to be loaded to saturate the sheets, but may be applied in proportions to other treatment chemicals, and to provide a cumulative amount that will be transferred to the batch of articles to achieve a target amount of a treatment chemical, or chemicals, to be retained by the article. That is to say that if a single treatment sheet can hold a first amount of treatment chemicals, then it may hold three different treatment chemicals which combine to be equal to or less than the first amount.

Having the amount of treatment chemicals less than a saturation of the chemicals in the treatment sheets may be preferred for treating a batch of a large number of articles. In this, the treatment sheets will need to interact with most, if not all of the articles in the batch. Having each of the treatment sheets containing a full load (e.g., be at saturation) of the treatment chemicals may require fewer treatment sheets, but that the treatment sheets interact with the articles for longer amounts of time. The treatment sheets and the articles may interact together for a longer period of time to transfer the target amounts of treatment chemicals to the articles. However, in some embodiments, it may be desirable to use more treatment sheets where each treatment sheet has less than a full load of the treatment chemicals. In those embodiments, the interaction between the articles and a greater number of treatment sheets may effectively transfer the target amount of treatment chemicals to the articles within a desired time period.

In many cases, these treatment chemicals may be added to treatment sheets by spraying them onto treatment sheet material as it passes by a spray head or a series of spray heads. The sheet material may be unwound from a source roll and rolled onto an accumulator roll to produce a roll of treatment sheets. In some embodiments, the treatment sheets may be used immediately after spraying on the treatment chemicals. In another embodiment, the treatment sheets may be allowed to air-dry to remove some moisture before they are used. In a preferred embodiment, the treatment chemicals may be sprayed onto a face of a roll of treatment material as it is being unrolled, heat-dried, and then rolled onto a receiving roll. In this embodiment, the heat dryer may be an oven where the roll is passed through at a predetermined speed, and applying the treatment chemicals may be done in a coater of with spray heads arranged so that the treatment material is sprayed before entering the oven to dry.

If the treatment chemical is sprayed on the treatment sheet material at a configured rate, this embodiment will provide a known concentration of that treatment chemical as it passes the spray heads. That is to say that if the treatment chemical, or chemicals, is applied at a steady rate as the treatment sheet material is drawn past the spray heads at a steady rate, then the treatment chemicals will be evenly distributed on the treatment sheet material. From that, those of ordinary skill will be able to determine how much of the treatment chemical is contained in the treatment sheet material in a linear basis. That is to say that if the sprayers coat the treatment sheet material at a known rate as the treatment sheet material is passing the sprayers, then it can be determined how much treatment chemical will be on a linear foot or meter of the length of the treatment sheet material. It will also be known how much treatment chemical will be contained on a piece of the treatment sheet material by measuring an area of the treatment sheet material. This may be used to determine how much treatment chemical is on an individual treatment sheet.

Knowing this amount per individual treatment sheet will allow an operator to know how many individual treatment sheets will be needed to treat a face-weight or a total-weight of a batch of articles to be treated.

If a coater is used, the width of the roll of treatment material may be between 6 feet and 12 feet (1.8 meters to 3.6 meters) to effectively match the width of the coater and the oven.

In other embodiments, treatment chemicals may be loaded onto a treatment sheet by immersing the treatment sheets into a pool of the treatment chemicals; by dredging the treatment sheets through a film of treatment chemicals; by powder coating the treatment sheets with treatment chemicals; by a padding method; and by applying the treatment chemicals by a kiss roller or a lick roller. The methods of preparing the treatment chemicals may be the same for applying them to the treatment sheets, or they may be applied in other ways as disclosed herein.

In a preferred embodiment, the treatment chemicals to be loaded onto treatment sheet material may be mixed together before being sprayed onto the treatment sheet material. That is to say that proportions of each treatment chemical may be determined and amounts reflecting those proportions will be mixed together and applied to a determined area of treatment sheet material. This need not be a batch operation; the chemicals may be mixed in-line just before being sent to the spray head or coater.

In some embodiments, it may be preferred to mix the chemicals in their concentrate form. The resulting mixture may have a preferable viscosity to use in a coater. If the resulting mixture has a viscosity that is not desired to be used with a coater or with spray heads, the mixture may be diluted or otherwise treated to obtain a preferred consistency.

In other embodiments, treatment chemicals may be added to the treatment sheet material by applying the treatment chemicals to a surface, such as a roller, and then pressing the treatment sheet against the surface, or moving the treatment sheet over the surface. In a similar way, treatment chemicals may be added through a padding method.

In a preferred embodiment, all of the treatment chemicals may be applied together on the treatment sheet with the treatment sheet thereafter being dried. However, in some embodiments, it may be preferable to load some of the treatment chemicals onto the treatment sheet, dry the treatment sheet, add other treatment chemicals onto the treatment sheet, and then perform another drying. The process of loading and treating may be done repetitively to obtain target amounts of treatment chemicals on the treatment sheets and a desired amount of moisture.

In a preferred embodiment where the heat dryer is an oven, a temperature may be chosen to remove the water from the treatment sheets. However, care must be taken to not degrade any of the treatment chemicals or to provide enough energy to cause them to react. In preferred embodiments, the temperature of the oven may be above 180° F. (82.2° C.); may be above 200° F. (93.3° C.); may be above the boiling temperature of water; may be above 250° F. (121.1° C.); or may be below 300° F. (148.9° C.). In a preferred embodiment, the temperature of the oven may be between 260° F. (126.7° C.) and 275° F. (135° C.).

The pace of advancement of the treatment sheet roll may be sufficiently fast enough to obtain a desired moisture level in the treatment sheet as it passes through the oven. That is to say that in some embodiments, it may be desirable to drive off all moisture from the treatment sheets, while in other embodiments, it may be desirable to have some moisture retained in the treatment sheets. Those of ordinary skill in the art will be able to set the pace of advancement to achieve desired results.

In some embodiments, the sheet material may be perforated while it is being unrolled and rolled to enable tearing of the treatment sheet into individual sheets. In some embodiments, it may be preferable to slice the treatment sheet material to produce rolls of treatment sheets with more desirable widths. Preferred embodiments have a treatment sheet roll width of about 12 inches (about 30.5 cm). Therefore, it may be preferable to slice the treatment sheet into 12-inch widths (30.5 cm) while it is being unrolled, loaded, dried, and rerolled.

Also, a mark, or marks may be placed on a roll of treatment material while it is being prepared. Such marks may indicate a distance from the start or end of the treatment material. This may be used as a way to select an amount of treatment chemicals to be added to a batch of articles. For example, if the concentration of treatment chemicals in a treatment sheet roll is known, then a linear measure of the roll will have a specific amount of the treatment chemicals. Continuing the example of a fire retardant, a roll of treatment sheets may be configured to contain 20 grams of fire retardant per linear meter. An operator would then unroll 100 meters from the treatment sheet roll for treating 1,000 mats that require 2 grams of fire retardant per mat.

While most of these treatment chemicals are water-soluble and may be spayed or coated onto the sheet material while in a water-based solution, the treatment of articles with treatment sheets is not limited to only water-soluble treatment chemicals. Water-insoluble treatment chemicals may be added to treatment sheets by spraying on the water-insoluble treatment chemicals either by themselves, or while suspended in or dissolved in a non-aqueous solution. In this embodiment, it may be preferable to load the water-soluble chemicals, dry the sheet, load the water-insoluble chemicals, and perform a final drying.

Transferring Target Amounts of Treatment Chemicals

Traditional methods 100 have relied upon a solvent or diluent to distribute and transfer treatment chemicals to articles in batches of articles. As noted, such methods are inefficient and produce wastewater. Applicant's improved method 200 does not use a solvent or diluent to distribute or transfer treatment chemicals. Since no solvent or diluent is used, there is no wastewater resulting from this operation. Additionally, the efficacy of transferring treatment chemicals is improved in Applicant's improved method 200.

Applicant has found that to transfer a target amount of each treatment chemical to the articles in a timed drying operation, the treatment sheets may be configured with specific amounts of treatment chemicals where the efficacy of transfer for the time will result in the target amount of treatment chemical being transferred to the articles.

In some cases, it may be desirable to retain and process the treatment sheets after they have been used so that treatment chemicals remaining in the used treatment sheets may be recovered.

Applicant has found that desirable amounts of the treatment chemicals may be transferred from the treatment sheets to the articles during a drying cycle when they are configured to transfer those amounts. That is to say that treatment sheets may be loaded with predetermined amounts of treatment chemicals; the loaded treatment sheets are used in a drying cycle with a batch of articles; and the articles have been found to have been sufficiently treated with the treatment chemicals.

This does not mean that all of the treatment chemicals that were originally loaded into the treatment sheets were transferred to the articles during the drying cycle. In some cases, Applicant has found that a desirable amount of the treatment chemicals had been transferred to all of the articles in a first batch, but a sufficient load of treatment chemicals remained in the treatment sheets so that they could be used to treat a second batch of articles in another drying cycle.

Applicant has found ways to measure an efficacy of transfer for transferring each treatment chemical from a treatment sheet to an article in a batch and to use that efficacy to determine a number of treatment sheets (or a length of a roll of treatment material) to use to transfer target amounts of treatment chemicals to articles in a batch of articles in a timed drying operation.

In a first embodiment, treatment sheets may be loaded with treatment chemicals so that they become single-use items. In this embodiment, the treatment sheets or rolls of treatment sheets may be configured to contain treatment chemicals that have known transfer rates so that desirable amounts of each treatment chemical are transferred from the treatment sheets or roll to the articles to be treated in a timed drying cycle. An exemplary scenario of this embodiment may be that a treatment sheet may be loaded with two treatment chemicals, where it is known that the first treatment chemical has a 100% transfer and retention efficacy, but the second treatment chemical has only a 75% efficacy. That is to say that during a timed drying cycle, all of the amount of the first treatment chemical is transferred from the treatment sheets or roll to the articles, but only 75% of the amount of the second treatment chemical is transferred. For these treatment chemicals in this scenario, the treatment sheet or roll may be loaded with amounts of the first and second treatment chemicals so that desirable amounts of those chemicals are transferred to the articles within a timed drying operation. In this embodiment, operators may be instructed to discard the treatment sheets or roll after a single use even though some amount of the second treatment chemical remains in the treatment sheets or rolls.

In this exemplary embodiment, even with a 75% efficacy of transfer and retention, a target amount of the treatment chemical can still be transferred to the articles in a batch. That is to say that a sufficient number of treatment sheets may be added to a batch of articles such that the articles will retain a target amount of that treatment chemical while 25% of the treatment chemical will remain on the treatment sheets.

In another embodiment, treatment sheets may be loaded with treatment chemicals so that they become multi-use items. In this embodiment, the treatment sheets or rolls of treatment sheets may be configured to contain treatment chemicals that have known transfer rates so that desirable amounts of each treatment chemical are transferred from the treatment sheets or roll to the articles to be treated in multiple timed drying cycles. An exemplary scenario of this embodiment may be that a treatment sheet may be loaded with two treatment chemicals, where it is known that the first treatment chemical has a 50% efficacy, but the second treatment chemical has only a 40% efficacy. That is to say that during a timed drying cycle, half of the amount of the first treatment chemical is transferred from the treatment sheets or roll to the articles, but only 40% of the second treatment chemical is transferred. For these treatment chemicals in this scenario, the treatment sheet or roll may be loaded with amounts of the first and second treatment chemicals so that desirable amounts of those chemicals are transferred to the articles within a first timed drying operation. Therefore, if it is desirable to use the treatment sheets or rolls for two timed drying operations, the treatment sheets or rolls can be loaded with sufficient amounts of the treatment chemicals to effectively transfer desirable amounts of those treatment chemicals to articles in two drying cycles. After the treatment sheets or rolls have been used for the first timed drying cycle, they will still retain sufficient amounts of the treatment chemicals so that the sheets or rolls may be used in a second timed drying operation. In this embodiment, operators may be instructed to use the treatment sheets or roll for a number of times, and to discard them after that number of uses.

In another embodiment, treatment sheets may be loaded with treatment chemicals so that they become reusable. In this embodiment, the treatment sheets or rolls of treatment sheets may be configured to contain treatment chemicals that have known transfer rates so that desirable amounts of each treatment chemical are transferred from the treatment sheets or roll to the articles to be treated in multiple timed drying cycles. An exemplary scenario of this embodiment may be that a treatment sheet may be loaded with two treatment chemicals, where it is known that the first treatment chemical has a 100% efficacy, but the second treatment chemical has only a 50% efficacy. That is to say that during a timed drying cycle, all of the amount of the first treatment chemical is transferred from the treatment sheets or roll to the articles, but only 50% of the second treatment chemical is transferred. For these treatment chemicals in this scenario, the treatment sheet or roll may be loaded with amounts of the first and second treatment chemicals so that desirable amounts of those chemicals are transferred to the articles within a first timed drying operation. That is, a treatment sheet or roll will be depleted of the first treatment chemical after a single timed drying operation, but half of the amount of the second treatment chemical will be retained in the treatment sheets or rolls. After a first timed drying operation, there will be no amount of the first treatment chemical left in the treatment sheets or rolls, but there will be an amount of the second treatment chemical left to use the treatment sheet or roll for a second time. Therefore, if it is desirable to use the treatment sheets or rolls for a second drying operation, the treatment sheets or rolls can be reloaded with an amount of the first treatment chemical for a second timed drying operation. Beyond this simplistic exemplary scenario, treatment sheets and rolls may be configured with many treatment chemicals with known amounts and efficacies. At any time when a treatment chemical is not present in a sufficient amount to treat a batch of articles, it may be reloaded with that treatment chemical. In some embodiments, it may be desirable to not only load the treatment sheets or rolls with treatment chemicals that must be reloaded for proper operation, but to also top off other treatment chemicals while the treatment sheets or rolls are being refurbished. In this embodiment, operators may be instructed to use the treatment sheets or roll for a number of times, and then to reload them before any further use.

From the simplified exemplary calculations above and the associated embodiment and scenarios, those in possession of the inventions disclosed and taught herein will understand that treatment sheets may be configured to achieve specific goals. In an exemplary embodiment, it may be known that each article is to be treated with specific amounts of treatment chemicals A, B, and C. A technician could then make a ream or a roll of treatment sheets where each sheet or the entire roll contains specific amounts of treatment chemicals A, B, and C in specific ratios to each other to meet the requirements of treating the articles. These amounts and ratios may take into account the efficacy of transfer and retention from the treatment sheet to the article as well. Then, knowing how many articles will be in a batch to be treated (or knowing a face-weight or a total-weight of the articles), an operator can determine a number of sheets or a length of a roll to add to the batch of articles.

Those in possession of the teachings and inventions disclosed herein will understand that any waste from this process will be solid waste rather than wastewater. The solid waste will be in the form of treatment sheets that may, or may not, have remaining treatment chemicals in them.

Treating Uncolored Textile Products

The articles referred to in this disclosure are not limited to those described herein. Those ordinarily skilled in the art and in possession of this disclosure will understand that the methods and processes disclosed herein may be applied to all textile products, including but not limited to: rugs, mats, carpets, carpet tiles, griege fabrics, garments, cloth, and other items. In these, the articles may be tufted, woven, nonwoven, or otherwise created. The articles may, or may not, have a backing or multiple backings.

The methods disclosed and taught herein may be used on soft surfaces and textile products that have not been previously colored. This includes, but is not limited to: greige products, woven products, unwoven products, tufted products, fabrics, and similar products known to those ordinarily skilled in the art. In the improved method 200, this process would start at the first step 201 if the uncolored product or fabric is to be colored.

These products may be made of polyester polymers, such as but not limited to polyethylene terephthalate (PET) and its copolymers; polyamide polymers, such as but not limited to nylon homopolymers and copolymers; and many other thermoplastic polymers known to those ordinarily skilled in the art.

Treating Solution Dyed Textile Products

The methods disclosed and taught herein are not limited to embodiments of dying uncolored textile products with treatment sheets. Embodiments of treating solution dyed textile products have also been successful, with and without further dyeing. The solution dyed textile products may also be thermoplastic polymers known to those ordinarily skilled in the art.

In a first exemplary embodiment of treating solution dyed textile products, the textile products may be solution dyed to an intermediate color, then dyed in a vat as described in the method 200 of treating textile products to bring the textile products to a final color.

In a second exemplary embodiment of treating solution dyed textile products, the textile products may be solution dyed to a final color, then processed using the method 200 starting at Step 203, where the textile products are moved to a dryer. In one exemplary embodiment, the textile products may be dry when they are moved to the dryer and the treatment sheets added with them. In another exemplary embodiment, the solution dyed textile products may be wetted with water before, or while they are being moved to the dryer. In some cases, wetting the solution dyed soft surfaces may provide some additional loft to the pile while it is being dried in the dryer.

Treating the Backings of the Articles

The methods disclosed and taught herein are not limited to embodiments of where the only target of the treatment chemicals is the fabric. This may be the pile of a soft surface articles such as a rug, carpet, or mat. In some embodiments, treatment sheets may be loaded with treatment chemicals designed to be transferred to and retained by the backings of the articles. One exemplary but non-limiting embodiment of this may be to transfer a plasticizer to a latex backing. As will be known to those of skill in the art, backing material may comprise foamed latex; foamed rubber; styrene-butadiene (SB) latex; styrene-butadiene rubber (SBR) latex; carboxylic-styrene-butadiene rubber; natural rubber latex; vinyl acetate ethylene copolymers (such as VAE or EVA); other natural or synthetic rubbers; urethanes; or polymers such as PET and coPET.

In an envisioned embodiment, the treatment sheets may be loaded with a resin having a melt temperature below the temperature of the dryer. In this way, the resin will be retained in the treatment sheet until it is loaded into a dryer. When the temperature of the dryer is raised above the melting point of the resin treatment chemical, the resin will melt and be transferred to the articles. Alternatively, particles may be transferred just through the friction of contact. One non-limiting exemplary embodiment of this may be to apply a tackifier to the backings of the articles. The exemplary tackifier may be loaded on to the treatment sheets in a molten state by a spray application and allowed to solidify as particles bonded to the treatment sheets. When added to a warm dryer, the particles would melt and be transferred to the backings of the articles.

Those of skill in the art and in possession of the inventions disclosed and taught herein will be able to envision and practice the transfer of similar treatment chemicals to be applied to other target portions of the fabric articles without departing from the spirit of the inventions disclosed and taught herein.

Treatment Sheets as a Defect Reducer

In the traditional method 100 of treating articles, some number of articles with backings have been discarded from each batch because they were found to contain processing defects in their backings after being treated in the wet phase. The processing defects rendered the articles unsellable.

The prevalent processing defect from an optimal traditional method 100 has been flaking in the backing. This is a condition where some portion or portions of the backing appears to have been abraded to an extent that the backing exhibits some tears, galling, rasping, excoriation, or chafing. While most of these processing defects are only visual imperfections, consumers will generally choose and purchase a product that has no imperfections over a product that exhibits any appearance of an imperfection.

It has been postulated that the abrading of the backings may be a result of the drying process where the backings of articles excessively rub against each other. Efforts have been made to ease, reduce, or eradicate the chafing by introducing a wetting agent into the wet phase of processing. However, as noted, the introduction of treatment chemicals into the wet phase has frequently resulted in the batch of articles exhibiting unleveled colors or imperfect dyeing. This is where the articles are not equally and consistently dyed to the same color. This includes where a single article has striations, color variances, or color gradients, and also where different articles in the batch show different colors. Additionally, wetting agents are costly and, when they are added to the wet phase, become additional components of the wastewater that must be processed to return the water to a potable state.

Applicants have found that the improved method 200 produces articles that have few, if any, processing defects. In one aspect, the improved method 200 does not introduce any new components into the wet phase. This allows the dye solution to permeant and be retained consistently in the faces of the articles. This overcomes the color leveling issues. In another aspect, the undiluted treatment chemicals in the treatment sheets produce articles that show no or very little flaking. In one embodiment, the undiluted treatment chemicals may act as a lubricant to prevent any abrading of the backing without transferring any treatment chemical to the backing. In another embodiment, some treatment chemical may be transferred to the backing upon some contact between the two, but none of the treatment chemicals intended to be retained by the pile material are retained by the backing but instead further transferred to the fabric of the articles.

Historical data from other batches of articles being treated with treatment chemicals in the wet phase has shown that an average of about 5% of the articles did not pass inspection because of flaking after treatment. That is to say that from a typical batch of about 320 articles, between 12 and 20 of the articles were found to have checking. The articles that had checking had to be reprocessed. In the trials described and conducted herein, of a typical batch of 320 articles, between none and three articles were found to have checking on them such that they had to be reprocessed. That is to say that the average of 0.5% of the articles treated with treatment sheets as disclosed herein were reprocessed. That is an average reduction in the defect rate of 90% from the checking on the backings of the treated articles.

Testing Methods

Finish-on-yarn (FOY) testing is generally performed using a cold solvent extraction method. This test measures amounts of the treatment chemicals retained on the articles but that are still releasable in the cold extraction solvents. This has permitted the Applicant to define test methodologies and gather some information about the transfer of the treatment chemicals to the articles. That is to say that a treatment chemical applied in the wet phase may be transferred to and retained in the article to a desired degree. The article may be dried and any chemicals retained by the articles may be extracted by cold solvents. The solvents may be evaporated and the residue, which will be the treatment chemical, may be weighed and compared against the face-weight of the articles to give an indication of the effectiveness of the retention.

Applicant has amassed empirical information regarding the efficacy and retention of many treatment chemicals applied to articles. This has been used to determine amounts of treatment chemicals needed to be added to the wet phase of batches of articles to provide a final FOY amount relative to the face-weight of the articles in the batch.

In setting up these trials, Applicant used the same amount as would be added to the wet phase to obtain a desirable FOY to add to the treatment sheets to obtain the same desirable FOY. That is to say that if an addition of a specific amount of softener to a batch of articles with a known face-weight were to produce a target FOY percent, then the same amount of that treatment chemical was applied in making treatment sheets for the same face-weight in anticipation of producing the same FOY percent. This assumes the same efficacy. Those of skill in the art and in possession of the inventions disclosed and taught herein will know of ways to measure the actual retention of treatment chemicals on treated articles, and may use that information to determine an efficacy of transfer from amounts of that treatment chemical originally applied to a batch of treatment sheets.

Since not all of the treatment chemicals are recoverable by cold solvent extraction methods and not all articles are entirely resistant to those solvents, Applicant tested for effectiveness of the application of the treatment chemicals rather than attempting to determine an exact amount of treatment chemical retained on the articles.

The treatment chemicals and tests were for soft-hand feel, ignition/flammability, and stain release, and antimicrobials as described below. The trials and results of the testing indicated that effective amounts of treatment chemicals were being transferred to and retained by the articles through the use of treatment sheets.

Soft-hand Evaluation tests were each performed with a multi-person panel from a group of 9" by 9" (22.9 cm by 22.9 cm) samples cut from the articles.

The Standard Method for Ignition Characteristics of Finished Textile Floor Covering Materials testing was performed in accordance with ASTM D2859-16(2021) and yielded pass/fail results.

This test method to measure the ability of fabrics to release oily stains during home laundering was performed in accordance with the AATCC 130-2015 method using synthetic blood, simulated urine, coke, whole milk, black coffee, and grape juice.

Trials and Results

In each trial, approximately 600 treatment sheets were prepared and secured into 6 bundles of approximately 100 treatment sheets each. Each bundle was secured with a staple. The bundles of treatment sheets were added to batches of approximately 320 freshly dyed bathmats, which were still wet as they were added to a dryer. Each batch was dried for approximately 45 minutes at a temperature of about 315° F. (about 157.2° C.). The bathmats were removed from the dryer and were tested by the methods described.

Trial 1

The treatment sheets were prepared with a softener. The treatment sheets were prepared by soaking 9" by 9" (22.9 cm by 22.9 cm) sheets of treatment sheet material in a concentrated solution of the treatment chemical and were allowed to dry. Batches of bathmats were dyed blue in the wet phase and loaded into a dryer while still wet. The piles of the bathmats were filaments of PET, and the backing was latex.

Batch #1.1 was dyed in the wet phase without any treatment chemical added. This untreated batch was used as a control.

Batch #1.2 was treated with the treatment sheets in the dry phase with a target FOY of 1%.

Batch #1.3 was treated with the softener in the wet phase with a target FOY of 2%.

Batch #1.4 was treated with the softener in the wet phase with a target FOY of 4%.

| | #1.1-Control | #1.2-Sheets | #1.3-Wet | #1.4-Wet |
|---|---|---|---|---|
| FOY Target | — | 1.00% | 2.00% | 4.00% |
| Soft-hand | Control (3) | 4.8 | 2.8 | 2.6 |
| Flammability | 5/8 | 8/8 | 8/8 | 7/8 |

The batch treated with the treatment chemical in the treatment sheets had a much greater hand-feel as compared to the control batch than the batches that were treated in the wet phase with the same treatment chemical.

All articles used in this trial were dyed blue in the wet phase. At the end of the dry phase, none of the articles in any of the batches displayed any discoloration.

Trial 2

The treatment sheets were prepared with a softener. The treatment sheets were prepared by soaking 9" by 9" (22.9 cm by 22.9 cm) sheets of treatment sheet material in a concentrated solution of the treatment chemical and were allowed to dry. Batches of bathmats were dyed blue and loaded into a dryer while still wet. The piles of the bathmats were filaments of PET, and the backing was latex.

Batch #2.1 was dyed in the wet phase without any treatment chemicals added. This untreated batch was used as a control.

Batch #2.2 was treated with the treatment sheets in the dry phase with a target FOY of 1%.

| | #2.1-Control | #2.2-Sheets |
|---|---|---|
| FOY Target | — | 1.00% |
| Soft-hand | Control (3) | 4.4 |
| Flammability | 6/8 | 7/8 |

The batch treated with the treatment chemical in the treatment sheets had a much greater hand-feel as compared to the control batch treated in the wet phase with the same treatment chemical.

All articles used in this trial were dyed blue in the wet phase. At the end of the dry phase, none of the articles in any of the batches displayed any discoloration.

Trial 3

The treatment sheets were prepared with a softener, a fire retardant, and a soil release agent. The treatment sheets were prepared by soaking 9" by 9" (22.9 cm by 22.9 cm) sheets of treatment sheet material in a concentrated solution of the treatment chemicals and were allowed to dry. Batches of bathmats were dyed pink and loaded into a dryer while still wet. The piles of the bathmats were filaments of Nylon, and the backing was latex.

Batch #3.1 was treated with treatment sheets loaded with a soil release agent in the dry phase.

| | #3.1-Nylon |
|---|---|
| FOY Target | 1.00% |
| Soil Release 1 | The grape juice was not entirely washed away. |
| Soil Release 2 | The grape juice and coffee were not entirely washed away. |

This batch treated with the treatment chemicals in the treatment sheets had a much greater hand-feel as compared to the control batch than the batches that were treated in the wet phase with the same treatment chemicals. The soil release evaluations showed that there was an effective amount of soil release treatment chemical transferred to the mats to effectively release most of the staining agents in a normal wash.

All articles used in this trial were dyed pink in the wet phase. At the end of the dry phase, none of the articles in this batch displayed any discoloration.

Trial 4

The treatment sheets were prepared with a softener and a fire retardant. The treatment sheets were prepared by soaking 9" by 9" (22.9 cm by 22.9 cm) sheets of treatment sheet material in a concentrated solution of the treatment chemicals and were allowed to dry. Batches of bathmats were dyed gray and loaded into a dryer while still wet. The piles of the bathmats were filaments of PET, and the backing was latex.

Batch #4.1 was dyed in the wet phase without any treatment chemicals added. This untreated batch was used as a control.

Batch #4.2 was treated with the treatment sheets in the dry phase with a target FOY of 2%. Batch #4.3 was treated with the treatment sheets in the dry phase with a target FOY of 4%.

| | #4.1-Control | #4.2-Sheets | #4.3-Sheets |
|---|---|---|---|
| FOY Target | — | 2.00% | 4.00% |
| Soft-hand | Control (3) | 3.5 | 4.2 |
| Flammability | 4/4 | 4/4 | 4/4 |

Both batches treated with the softener chemicals in the treatment sheets had a much greater hand-feel as compared to the control batch. All of the tested mats passed the ignition tests.

All articles used in this trial were dyed gray in the wet phase. At the end of the dry phase, none of the finished articles in this batch displayed any discoloration.

Trial 5

The treatment sheets were prepared with a softener and a fire retardant. The treatment sheets were prepared by soaking 9" by 9" (22.9 cm by 22.9 cm) sheets of treatment sheet material in a concentrated solution of the treatment chemicals and were allowed to dry. Batches of bathmats were dyed off-white and loaded into a dryer while still wet. The piles of the bathmats were filaments of solution dyed nylon, and the backing was latex.

Batch #5.1 was treated with the treatment sheets in the dry phase with a target FOY of 2%. Batch #5.2 was treated with the treatment sheets in the dry phase with a target FOY of 4%.

| | #5.1-Sheets | #5.2-Sheets |
|---|---|---|
| FOY Target | 2.00% | 4.00% |
| Flamability | 4/4 | 3/4 |

Both batches treated with the softener chemicals in the treatment sheets had a much greater hand-feel as compared to the control batch. The tested mats in batch #5.1 passed the ignition tests while 3 of the 4 mats tested in batch #5.2 passed.

All of the solution dyed nylon articles used in this trial were dyed off-white in the wet phase. At the end of the dry phase, none of the articles in this batch displayed any discoloration.

Trial 6

The treatment sheets were prepared with a softener, a fire retardant, and a soil release agent. The treatment sheets were prepared by soaking 9" by 9" (22.9 cm by 22.9 cm) sheets of treatment sheet material in a concentrated solution of the treatment chemicals and were allowed to dry. The articles in batch #6.1 were solution dyed nylon, dyed off-white, and loaded into a dryer while still wet. The articles in batch #6.2 were solution dyed nylon, dyed pink, and loaded into a dryer while still wet. The backings of the articles were latex.

Batch #6.1 was treated with the treatment sheets in the dry phase with a target FOY of 2%. Batch #6.2 was treated with the treatment sheets in the dry phase with a target FOY of 4%.

| | #6.1-Sheets | #6.2-Sheets |
|---|---|---|
| FOY Target | 2.00% | 4.00% |
| Soil Release 1 | The grape juice was not entirely washed away. | All stains removed after washing. |
| Soil Release 2 | The grape juice and coffee were not entirely washed away. | All stains removed after washing. |

The soil release evaluations showed that there was an effective amount of soil release treatment chemical transferred to the mats in batch #6.2 to effectively release all of the staining agents in a normal wash.

All of the solution dyed nylon articles used in this trial were dyed in the wet phase. At the end of the dry phase, none of the articles in either batch displayed any discoloration.

Trial 7

The treatment sheets were prepared with a softener and a fire retardant. The treatment sheets were prepared in a coater by spraying a solution of concentrated treatment chemicals onto the treatment sheet material as it was unrolled. The material was heated to dry it before being rerolled. The material was then cut into sheets of about 12" by about 9" (about 30.5 cm by about 22.9 cm), Batches of bathmats were dyed and loaded into a dryer while still wet. The backings of all of the articles were latex.

Batch #7.1 was a batch of PET bathmats and was treated with the wet phase with a target FOY of 4%. Batch #7.2 was treated with the treatment sheets in the dry phase with a target FOY of 4%.

| | #7.1-Wet | #7.2-Sheets |
|---|---|---|
| FOY Target | 4.00% | 4.00% |
| Soil Release | -not tested- | All stains removed after washing. |
| Flammability | 4/4 | 4/4 |

The soil release evaluations showed that there were effective amounts of soil release and fire retardant treatment chemicals transferred to the mats in batch #7.2 to effectively release all of the staining agents in a normal wash and to pass the ignition test.

All articles used in this trial were dyed pink in the wet phase. At the end of the dry phase, none of the articles in this batch displayed any discoloration.

Trial 8

The treatment sheets were prepared with a softener, a fire retardant, and an antimicrobial agent. The treatment sheets were prepared in a coater by spraying a solution of concentrated treatment chemicals onto the treatment sheet material as it was unrolled. The material was heated to dry it before being rerolled. The material was then cut into sheets of about 12" by about 9" (about 30.5 cm by about 22.9 cm), Batches of bathmats were dyed and loaded into a dryer while still wet. The backings of all of the articles were latex.

Batch #8.1 was a batch of blue PET bathmats and was treated with treatment sheets in the dry phase with a target FOY of 4% with a softener. Batches #8.2 and #8.3 were treated with the treatment sheets in the dry phase with a target FOY of 4% with a softener, a fire retardant, and an antimicrobial agent. The antimicrobial agent comprised silver. The amount of the antimicrobial retained in the trial batches was measured using X-ray fluorescence and any amount greater than 25 ppm indicates an acceptable effectiveness level of the antimicrobial.

| | #8.1-Control | #8.2-Sheets | #8.3-Sheets |
|---|---|---|---|
| FOY Target | 4.00% Softener | 4.00% Softener, Fire retardant, antimicrobial | 4.00% Softener, Fire retardant, antimicrobial |
| Antimicrobial | 4 ppm | 57 ppm | 37 ppm |
| Flammability | 4/4 | 4/4 | 4/4 |

The soil release evaluations showed that there were effective amounts of soil release and fire retardant treatment chemicals transferred to the mats in batch #7.2 to effectively release all of the staining agents in a normal wash and to pass the ignition test.

Batch #8.2 was dyed brown and batch #8.3 was dyed green. At the end of the dry phase, none of the articles in these batches displayed any discoloration. The antimicrobial agent was found in both the fabric and the backings of the mats.

Trial 9

Two different types of treatment sheets were trialed from different suppliers. Each set of treatment sheets were prepared with a softener and a fire retardant. The treatment sheets were prepared in a coater by spraying a solution of concentrated treatment chemicals onto the treatment sheet material as it was unrolled. The material was heated to dry it before being rerolled. The material was then cut into sheets of about 12" by about 9" (about 30.5 cm by about 22.9 cm), Batches of PET bathmats were dyed blue and loaded into a dryer while still wet. The backings of all of the articles were latex.

Batches #9.1 and #9.2 were treatment sheets from a first supplier, while batches #9.3 and #9.4 were from a second supplier. Batch #9.1 was configured to deliver 2% FOY; batch #9.2 was configured to deliver 8% FOY; batch #9.3 was configured to deliver 4% FOY; and batch #9.4 was configured to deliver 8% FOY.

| | #9.1-Sheet 1 | #9.2-Sheet 1 | #9.3-Sheet 2 | #9.4-Sheet 2 |
|---|---|---|---|---|
| FOY Target | 2.00% | 8.00% | 4.00% | 8.00% |
| Soft-hand | 4.7 | 4.7 | 4.6 | 4.8 |
| Flammability | 4/4 | 4/4 | 4/4 | 4/4 |

Both types of treatment sheets produced the desired results of transferring treatment chemicals to the articles. Batches treated with the softener chemicals in the treatment sheets had a much greater hand-feel as compared to samples of articles from a control batch made with the treatment chemicals added in the wet phase. All tested mats passed the ignition tests.

All articles used in this trial were dyed blue in the wet phase. At the end of the dry phase, none of the articles in these batches displayed any discoloration.

Trial 10

The treatment sheets were prepared with a softener and a fire retardant. The treatment sheets were prepared in a coater by spraying a solution of concentrated treatment chemicals onto the treatment sheet material as it was unrolled. The material was heated to dry it before being rerolled. The material was then cut into sheets of about 12" by about 9" (about 30.5 cm by about 22.9 cm), Batches of bathmats were dyed and loaded into a dryer while still wet. The backings of all of the articles were latex.

Batch #10.1 was a batch of PET bathmats treated with treatment sheets in the dry phase with a target FOY of 4% with a softener. Batches #10.2 and #10.3 were treated with the treatment sheets in the dry phase with a target FOY of 4% with a softener and an odor control agent.

| | #10.1-Sheets | #10.2-Sheets | #10.3-Sheets |
|---|---|---|---|
| FOY Target | 4.00% Softener | 4.00% Softener and Odor Control | 4.00% Softener and Odor Control |
| Flammability | 4/4 | 4/4 | 4/4 |

All batches passed the ignition test. There were no compatibility issues with placing an odor control agent with a softener on the treatment sheets.

Batch #10.2 was dyed pink and batch #10.3 was dyed green. At the end of the dry phase, none of the articles in these batches displayed any discoloration.

Summary of Results

The trials listed herein demonstrate that treatment sheets have transferred treatment chemicals to articles in the dry phase of processing. The treatment sheets were loaded with desired amounts of treatment chemicals which were transferred and retained to target levels on the articles.

In these trials, chemicals that would otherwise be added individually to the wet phase of processing were loaded onto treatment sheets together. No difficulties were encountered in preparing treatment sheets with multiple treatment chemicals and no difficulties were encountered in transferring the chemicals to the articles from the loaded treatment sheets.

Once the color was set in the wet phase of the process, adding the treatment chemicals in the dry phase through transfer from treatment sheets did not alter the color or shading of the articles.

The ranges of the treatment chemicals transferred to the articles through the use of loaded treatment sheets are from about 0.5% to about 15% weight of fiber (WoF). In preferred embodiments, the ranges may be from about 1% to about 5% WoF.

The efficacy of the transfer of treatment chemicals from the treatment sheets to the articles was between about 90% and about 99%. In most cases, the efficacy was about 95%. That is to say that in most cases, only about 5% of the treatment chemical was not transferred from the treatment sheet to the articles in the batch.

In this improved process, the remaining treatment chemicals are not washed away, but are retained in the treatment sheets. The treatment sheets may be treated as solid waste or, more preferably, may be reused by reloading them with more treatment chemicals.

This is very different from articles treated with the same treatment chemicals in the wet phase where the efficacy has been measured to be between 80% and 85%. That is to say that between 20% and 15% of the treatment chemicals are washed away from the articles in the batch. The effluent water therefore must be treated and processed to make it potable.

That is to say that the reduction of treatment chemicals lost to waste by using the improved processes disclosed and taught herein for the treatment chemicals measured in the trials is at least 5% and more often closer to 20%. This reduction of loss is even higher for chemicals that don't transfer well in the wet phase such as sulfonated treatment chemicals that lose their effectiveness in the presence of most dyes.

Using this process has the advantages of being economically preferred by greatly reducing the waste of treatment chemicals and by eliminating the need to treat effluent wastewater.

Also, as noted, the number of articles that had to be reprocessed because of checking was reduced by between 85% and 100% (where there were no articles that had checking), with an average reduction of around 90%.

CONCLUSION

The present invention is in no way limited to the herein above-described embodiments. On the contrary, many such treatment sheets, treatment chemicals, and treating methods may be realized according to various variants, without leaving the scope of the present invention.

The invention claimed is:

1. A method for manufacturing a batch of soft surface articles, comprising:

providing a batch of unfinished soft surface articles comprising a fabric face and a backing;

dyeing the batch of soft surface articles in a water-based dye solution in a vat;

draining the water-based dye solution from the vat without refilling the vat;

transferring at least a portion of the batch of soft surface articles to a dryer;

adding at least one treatment sheet bundle to the dryer, and drying the at least a portion of the batch of soft surface articles with the at least one treatment sheet bundle;

wherein the at least one treatment sheet bundle comprises at least one treatment chemical; and wherein the at least one treatment sheet bundle comprises a plurality of individual treatment sheets secured together with a fastener.

2. The method of claim 1, wherein the composition of the at least one treatment chemical in the at least one treatment sheet bundle consists of a component chosen from: a softener; a wax; a soil-release agent; a biocide; an antimicrobial agent; a fire retardant; an odor eliminator; a perfume or other fragrance; an anti-static agent; a color fastness agent; a lightfastness agent; a UV absorber; an optical brightener; a leveling agent; an essential oil; or combinations thereof.

3. The method of claim 2, wherein an amount of the at least one treatment chemical in the at least one treatment sheet bundle is determined from a face-weight of the batch of soft surface articles.

4. The method of claim 2, wherein a number of treatment sheet bundles are added to the dryer and wherein the number is determined from:

an amount of the at least one treatment chemical loaded in each treatment sheet bundle;

a target amount of the at least one treatment chemical to be retained by each article in the batch of unfinished soft surface articles; and a total-weight of the portion of the batch of soft surface articles.

5. The method of claim 1, wherein the fastener comprises a deformable member.

6. The method of claim 5, wherein the deformable member comprises plastic or metal.

7. The method of claim 6, wherein the deformable member is a staple that pierces the plurality of individual treatment sheets of the at least one treatment sheet bundle.

8. The method of claim 7, wherein each individual sheet is comprised of a laminated sheet comprised of a plurality of layers.

9. The method of claim 1, further comprising rinsing the batch of unfinished soft surface articles after draining the water-based dye solution from the vat.

10. The method of claim 9, wherein the batch of unfinished soft surface articles are rinsed before transferring the at least a portion of the batch of soft surface articles to the dryer.

* * * * *